US010083670B2

(12) United States Patent
Wang

(10) Patent No.: US 10,083,670 B2
(45) Date of Patent: Sep. 25, 2018

(54) COMPENSATION CIRCUIT, DRIVE CIRCUIT AND OPERATING METHODS THEREOF, AS WELL AS DISPLAY DEVICE

(71) Applicants: Boe Technology Group Co., Ltd., Beijing (CN); Beijing Boe Display Technology Co., Ltd., Beijing (CN)

(72) Inventor: Jieqiong Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/122,570

(22) PCT Filed: Aug. 5, 2015

(86) PCT No.: PCT/CN2015/086142
§ 371 (c)(1),
(2) Date: Aug. 30, 2016

(87) PCT Pub. No.: WO2016/173138
PCT Pub. Date: Nov. 3, 2016

(65) Prior Publication Data

US 2017/0069284 A1 Mar. 9, 2017

(30) Foreign Application Priority Data

Apr. 28, 2015 (CN) ..... 2015 1 0208361

(51) Int. Cl.
*G09G 3/36* (2006.01)
*G09G 3/20* (2006.01)

(52) U.S. Cl.
CPC ..... *G09G 3/3696* (2013.01); *G09G 3/2007* (2013.01); *G09G 3/3655* (2013.01);
(Continued)

(58) Field of Classification Search
CPC .. G09G 3/3696; G09G 3/2007; G09G 3/3655; G09G 2310/0291;
(Continued)

(56) References Cited

U.S. PATENT DOCUMENTS 5,926,157 A 7/1999 Moon
2004/0233182 A1* 11/2004 Chuang ..... G09G 3/3611 345/204
(Continued)

FOREIGN PATENT DOCUMENTS

CN 1632647 A 6/2005
CN 102183852 A 9/2011
(Continued)

OTHER PUBLICATIONS

Decision on Rejection in Chinese Application No. 201510208361.X dated Mar. 14, 2017, with English translation. 12 pages.
(Continued)

*Primary Examiner* — Stephen G Sherman
(74) *Attorney, Agent, or Firm* — Womble Bond Dickinson (US) LLP

(57) ABSTRACT

The present disclosure provides a compensation circuit, a drive circuit, operating methods of the compensation circuit and the drive circuit, and a display device comprising the drive circuit. The compensation circuit comprises a first compensation module and a second compensation module. The first compensation module generates compensation voltage according to the variation of common electrode voltage, and the second compensation module superposes the compensation voltage inputted by the second input terminal on gamma voltage inputted by the first input terminal, and outputs the superposed gamma voltage. The technical solution above transfers a compensation position from the common electrode voltage to the gamma voltage,
(Continued)

and effectively compensates for and inhibits the fluctuation of the common electrode voltage by the compensation voltage superposed on the gamma voltage, thereby avoiding over high temperature of display panels, green tint of displayed images and crosstalk noise.

9 Claims, 3 Drawing Sheets

(52) U.S. Cl.
CPC ..... *G09G 2310/0291* (2013.01); *G09G 2320/0209* (2013.01); *G09G 2320/0219* (2013.01); *G09G 2320/041* (2013.01)

(58) Field of Classification Search
CPC ... G09G 2320/0209; G09G 2320/0219; G09G 2320/041
USPC ..... 345/690
See application file for complete search history.

(56) References Cited

U.S. PATENT DOCUMENTS

| | | | | |
|---|---|---|---|---|
| 2010/0268056 | A1 | 10/2010 | Picard et al. | |
| 2014/0168043 | A1* | 6/2014 | Zhang ..... | G09G 3/3692 345/90 |

FOREIGN PATENT DOCUMENTS

| | | | |
|---|---|---|---|
| CN | 102670183 | A | 9/2012 |
| CN | 103065594 | A | 4/2013 |
| CN | 103957793 | A | 7/2014 |
| CN | 104055499 | A | 9/2014 |
| CN | 104207756 | A | 12/2014 |
| CN | 104347048 | A | 2/2015 |
| CN | 104376829 | A | 2/2015 |
| CN | 104460076 | A | 3/2015 |
| CN | 104506193 | A | 4/2015 |
| CN | 104793806 | A | 7/2015 |
| CN | 104795036 | A | 7/2015 |
| EP | 2228628 | A1 | 9/2010 |

OTHER PUBLICATIONS

International Search Report and Written Opinion in PCT/CN2015/086142 dated Jan. 19, 2016, with English translation. 16 pages.
Office Action in Chinese Application No. 201510208361.X dated Sep. 29, 2016, with English translation. 12 pages.
International Search Report and Written Opinion in PCT/CN2015/090364 dated Feb. 4, 2016, with English translation. 18 pages.
Office Action in Chinese Application No. 201510208361.X dated Sep. 20, 2017, with English translation.

* cited by examiner

COMPENSATION CIRCUIT, DRIVE CIRCUIT AND OPERATING METHODS THEREOF, AS WELL AS DISPLAY DEVICE

RELATED APPLICATIONS

The present application is the U.S. national phase entry of PCT/CN2015/086142 with an International filing date of Aug. 5, 2015, which claims the benefit of Chinese Application No. 201510208361.X, filed on Apr. 28, 2015, the entire disclosures of which are incorporated herein by reference.

TECHNICAL FIELD

The present disclosure relates to the field of display technology, and more particularly to a compensation circuit, a drive circuit, operating methods of the compensation circuit and the drive circuit, and a display device comprising the drive circuit.

BACKGROUND

In the current display device, a coupling capacitor between a data line and a common electrode line leads to a variation of common electrode voltage, thereby reducing the quality of displayed images. To improve the quality of displayed images, it is needed to compensate common electrodes in the prior art. However, with an increase in the dimension of display panels, the load is getting heavier, so the display panels may have such a problem as an over high temperature.

SUMMARY

To solve or alleviate at least one of defects or problems in the prior art, some embodiments provide a compensation circuit, a drive circuit, operating methods of the compensation circuit and the drive circuit, and a display device comprising the drive circuit, for addressing the problem of over high temperature of display panels caused by compensation for common electrodes in the prior art.

According to one aspect, there is provided a compensation circuit comprising a first compensation module and a second compensation module that is provided with a first input terminal, a second input terminal and an output terminal;

the first compensation module is configured for generating compensation voltage according to the variation of common electrode voltage, and outputting the generated compensation voltage to the second input terminal of the second compensation module; and the second compensation module is configured for superposing the compensation voltage inputted by the second input terminal on gamma voltage inputted by the first input terminal, and outputting the superposed gamma voltage.

Optionally, the second compensation module comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, and the non-inverting input terminal is connected with the second input terminal.

Optionally, the first resistor has a resistance equal to that of the second resistor.

Optionally, a capacitor is connected in series between the second input terminal and the non-inverting input terminal.

According to another aspect, there is provided a drive circuit that comprises a first compensation module, a second compensation module, a gamma voltage module and a source drive module, wherein the second compensation module is provided with a first input terminal, a second input terminal and an output terminal;

the first compensation module is configured for generating compensation voltage according to the variation of common electrode voltage, and outputting the generated compensation voltage to the second input terminal of the second compensation module;

the gamma voltage module is configured for generating gamma voltage and outputting the generated gamma voltage to the first input terminal of the second compensation module;

the second compensation module is configured for superposing the compensation voltage on the gamma voltage; and the source drive module is configured for receiving the superposed gamma voltage from the output terminal of the second compensation module, and generating drive voltage according to the superposed gamma voltage.

Optionally, the second compensation module comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, the non-inverting input terminal is connected with the second input terminal, and the output terminal of the operational amplifier is connected with the source drive module.

Optionally, the first resistor has a resistance equal to that of the second resistor.

Optionally, a capacitor is connected in series between the second input terminal and the non-inverting input terminal.

According to another aspect, there is also provided a display device comprising any of the drive circuits as described above.

According to another aspect, there is also provided an operating method of a compensation circuit, wherein the compensation circuit comprises a first compensation module and a second compensation module that is provided with a first input terminal, a second input terminal and an output terminal;

the operating method comprises the steps of:

the first compensation module is configured for generating compensation voltage according to the variation of common electrode voltage, and outputting the generated compensation voltage to the second input terminal of the second compensation module; and the second compensation module is configured for superposing the compensation voltage inputted by the second input terminal on gamma voltage inputted by the first input terminal, and outputting the superposed gamma voltage.

Optionally, the second compensation module comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, and the non-inverting input terminal is connected with the second input terminal.

According to another aspect, there is also provided an operating method of a drive circuit, wherein the drive circuit comprises a first compensation module, a second compensation module, a gamma voltage module and a source drive module, and the second compensation module is provided with a first input terminal, a second input terminal and an output terminal;

the operating method comprises the steps of:

the first compensation module is configured for generating compensation voltage according to the variation of common electrode voltage, and outputting the generated compensation voltage to the second input terminal of the second compensation module;

the gamma voltage module is configured for generating gamma voltage and outputting the generated gamma voltage to the first input terminal of the second compensation module;

the second compensation module is configured for superposing the compensation voltage on the gamma voltage; and the source drive module is configured for receiving the superposed gamma voltage from the output terminal of the second compensation module, and generating drive voltage according to the superposed gamma voltage.

Optionally, the second compensation module comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, the non-inverting input terminal is connected with the second input terminal, and the output terminal of the operational amplifier is connected with the source drive module.

The technical solutions provided by some embodiments can achieve at least one of the following advantageous effects and/or other advantageous effects:

In the compensation circuit, drive circuit and operating methods thereof, as well as the display device, provided by some embodiments, the compensation circuit comprises a first compensation module and a second compensation module; the first compensation module generates compensation voltage according to the variation of common electrode voltage; and the second compensation module superposes the compensation voltage inputted by the second input terminal on gamma voltage inputted by the first input terminal, and outputs the superposed gamma voltage. The technical solution transfers a compensation position from the common electrode voltage to the gamma voltage, and effectively compensates for and inhibits the fluctuation of the common electrode voltage by the compensation voltage superposed on the gamma voltage, thereby avoiding over high temperature of display panels, green tint of displayed images and crosstalk noise.

BRIEF DESCRIPTION OF DRAWINGS

To explain the technical solutions in some embodiments more clearly, the drawings needed in the description of the embodiments will be briefly introduced. It should be realized that the following drawings only relate to some embodiments. Those skilled in the art can obtain other drawings according to these drawings without any inventive labour.

DETAILED DESCRIPTION

To assist those skilled in the art in better understanding the object, technical solutions and advantages of some embodiments, a compensation circuit, a drive circuit, operating methods of the compensation circuit and the drive circuit and a display device containing the drive circuit according to some embodiments will be further described in detail with reference to drawings.

Figure 1:
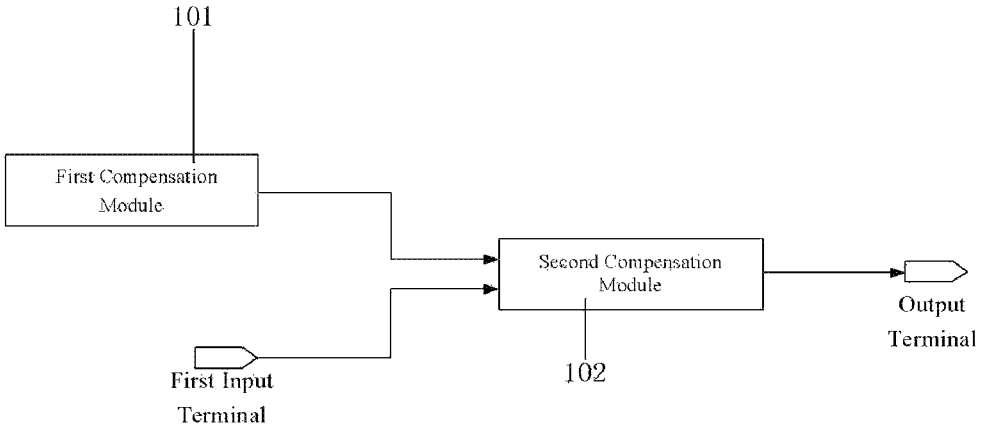
FIG. 1 is a structural schematic view of a compensation circuit according to an embodiment.

FIG. 1 is a structural schematic view of a compensation circuit according to an embodiment. As shown in FIG. 1, the compensation circuit comprises a first compensation module 101 and a second compensation module 102. The second compensation module 102 is provided with a first input terminal, a second input terminal and an output terminal. The first compensation module 101 generates compensation voltage according to the variation of common electrode voltage. The first compensation module 101 is connected with the second input terminal of the second compensation module 102 and outputs the generated compensation voltage to the second input terminal of the second compensation module 102. The second compensation module 102 superposes the compensation voltage inputted by the second input terminal on gamma voltage inputted by the first input terminal, and outputs the superposed gamma voltage.

In the present embodiment, the first compensation module 101 generates compensation voltage according to the variation of the common electrode voltage and then transmits the compensation voltage to the second compensation module 102. The first input terminal of the second compensation module 102 receives the gamma voltage, the second input terminal of the second compensation module 102 receives the compensation voltage, and the second compensation module 102 superposes the compensation voltage on the gamma voltage and then outputs the superposed gamma voltage. The superposed gamma voltage is applied to a pixel electrode by a source driver. The pixel electrode and a common electrode make up of a pixel capacitor, and the voltage difference between the pixel electrode and the common electrode decides a deflection angle of liquid crystal molecules within the pixel capacitor. That is to say, the voltage difference between the pixel electrode and the common electrode decides the gray scale of display panels. Under normal circumstances, the voltage of the common electrode is constant, and the deflection angle of liquid crystal molecules can be controlled by controlling the voltage of the pixel electrode, so as to achieve an expected display effect. However, when a capacitive coupling effect results in fluctuation of common electrode voltage, the voltage difference between the common electrode and the pixel electrode is no longer controllable. At that time, the second compensation module 102 can superpose a corresponding compensation voltage on the existing gamma voltage so as to maintain the voltage difference between the pixel electrode and the common electrode unchanged. That is to say, the compensation voltage can counteract the variation of the common electrode voltage so as to keep the voltage difference between the pixel electrode and the common electrode unchanged, thereby avoiding over high temperature of display panels, green tint of displayed images and crosstalk noise.

Figure 2:
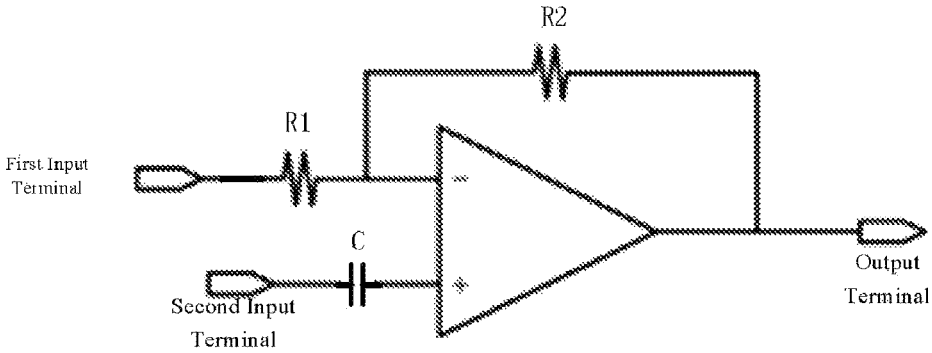
FIG. 2 is a structural schematic view of a second compensation module shown in FIG. 1 according to an embodiment.

FIG. 2 is a structural view of a second compensation module 102 shown in FIG. 1 according to an embodiment. As shown in FIG. 2, the second compensation module 102 may comprise an operational amplifier that is provided with a non-inverting input terminal, an inverting input terminal and an output terminal. A first resistor R1 and a second resistor R2 are sequentially connected in series between the first input terminal (namely, the first input terminal of the second compensation module 102) and the output terminal of the operational amplifier. The inverting input terminal is connected between the first resistor R1 and the second resistor R2. Optionally, the first resistor R1 has a resistance equal to that of the second resistor R2. Optionally, a capacitor C may be connected in series between the second input terminal (namely, the second input terminal of the second compensation module 102) and the non-inverting input terminal. The second compensation module 102 superposes the compensation voltage inputted by the second input terminal on gamma voltage inputted by the first input terminal, and outputs the superposed gamma voltage, so as to effectively compensate for and inhibit the fluctuation of the common electrode voltage, thereby avoiding over high temperature of display panels, green tint of displayed images and crosstalk noise.

In the present embodiment, it can be calculated by the operational amplifier that the inverting voltage of the operational amplifier is $V_-=(V_0-GAM)*R1/(R1+R2)$, the non-inverting voltage of the operational amplifier is $V_+=$ ▸ VCOM_FB, and $V_-=V_+$, wherein ▸ VCOM_FB is a compensation voltage generated by the first compensation module 101 according to the variation ▸ VCOM of the common electrode voltage, and $V_0$ is the output voltage of the operational amplifier. Thus, the output voltage of the operational amplifier is $V_0=$ ▸ VCOM_FB*(R1+R2)/R1+GAM. When the capacitive coupling effect causes the common electrode voltage to generate a fluctuated voltage ▸ VCOM, the second compensation module 102 superposes a corresponding compensation voltage ▸ VCOM_FB on the gamma voltage GAM, and then adjust the output voltage $V_0$ by the first resistor R1 and the second resistor R2, in order to keep the voltage difference between the pixel electrode and the common electrode unchanged, and avoid over high temperature of display panels, green tint of displayed images and crosstalk noise.

Optionally, the first resistor R1 has a resistance equal to that of the second resistor R2, at the time of which the output voltage of the operational amplifier is $V_0=2$ ▸ VCOM_FB+GAM, and thus the second compensation module 102 outputs two times of the compensation voltage ▸ VCOM_FB. When the capacitive coupling effect causes the common electrode voltage to generate a variation of ▸ VCOM, the voltage 2 ▸ VCOM_FB in the output voltage $V_0$ of the second compensation module 102 counteracts the variation ▸ VCOM of the common electrode voltage, thereby keeping the voltage difference between the pixel electrode and the common electrode unchanged. In the course of compensating for the common electrode voltage, the first resistor R1 and the second resistor R2 provided by the present embodiment can provide differently amplified compensation voltage to compensate for the common electrode voltage according to different requirements.

In a specific implementation, a capacitor is connected in series between the second input terminal and the non-inverting input terminal. Since the variation ▸ VCOM of the common electrode voltage caused by the capacitive coupling effect is mainly an alternate voltage, the capacitor C can filter the direct voltage from the compensation voltage ▸ VCOM_FB, and then make direct use of the alternate voltage to eliminate the interference of the direct voltage, thereby rendering the compensation result more accurate.

In the compensation circuit provided by the present embodiment, the compensation circuit comprises a first compensation module 101 and a second compensation module 102; the first compensation module 101 generates compensation voltage according to the variation of the common electrode voltage; and the second compensation module 102 superposes the compensation voltage inputted by the second input terminal on gamma voltage inputted by the first input terminal, and outputs the superposed gamma voltage. The present embodiment transfers a compensation position from the common electrode voltage to the gamma voltage, and effectively compensates for and inhibits the fluctuation of the common electrode voltage by the compensation voltage superposed on the gamma voltage, thereby avoiding over high temperature of display panels, green tint of displayed images and crosstalk noise.

Figure 3:
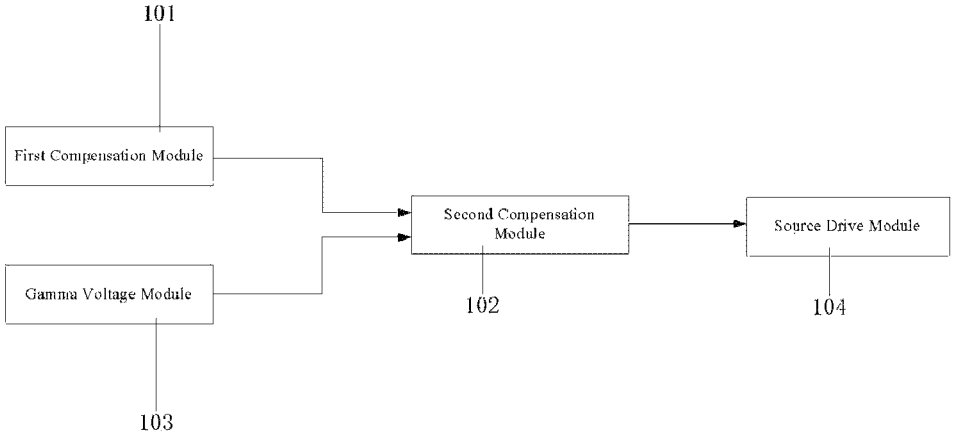
FIG. 3 is a structural schematic view of a drive circuit according to an embodiment.

FIG. 3 is a structural schematic view of a drive circuit according to an embodiment. As shown in FIG. 3, the drive circuit comprises a first compensation module 101, a second compensation module 102, a gamma voltage module 103 and a source drive module 104. The second compensation module 102 is provided with a first input terminal connected with the gamma voltage module 103, a second input terminal connected with the first compensation module 101 and an output terminal connected with the source drive module 104. The first compensation module 101 generates compensation voltage according to the variation of common electrode voltage, and outputs the generated compensation voltage to the second input terminal of the second compensation module 102. The gamma voltage module 103 generates gamma voltage and outputs the generated gamma voltage to the first input terminal of the second compensation module 102. The second compensation module 102 superposes the compensation voltage on the gamma voltage and outputs the superposed gamma voltage from the output terminal thereof to the source drive module 104. The source drive module 104 receives the superposed gamma voltage, and generates drive voltage according to the superposed gamma voltage.

In the present embodiment, the first compensation module 101 generates compensation voltage according to the variation of the common electrode voltage and then transmits the compensation voltage to the second compensation module 102. The gamma voltage module 103 generates gamma voltage and transmits the gamma voltage to the second compensation module 102. The first input terminal of the second compensation module 102 receives the gamma voltage, the second input terminal of the second compensation module 102 receives the compensation voltage, and the second compensation module 102 superposes the compensation voltage on the gamma voltage and then transmits the superposed gamma voltage to the source drive module 104. The source drive module 104 receives the superposed gamma voltage, and generates drive voltage according to the superposed gamma voltage. The drive voltage is applied to a pixel electrode. The pixel electrode and a common electrode make up of a pixel capacitor, and the voltage difference between the pixel electrode and the common electrode decides a deflection angle of liquid crystal molecules within the pixel capacitor. That is to say, the voltage difference between the pixel electrode and the common electrode decides the gray scale of display panels. Under normal circumstances, the voltage of the common electrode is constant, and the deflection angle of liquid crystal molecules can be controlled by controlling the voltage of the pixel electrode, so as to achieve an expected display effect. However, when a capacitive coupling effect results in fluctuation of common electrode voltage, the voltage difference between the common electrode and the pixel electrode is no longer controllable. At that time, the second compensation module 102 can superpose a corresponding compensation voltage on the existing gamma voltage so as to maintain the voltage difference between the pixel electrode and the common electrode unchanged. That is to say, the compensation voltage can counteract the variation of the common electrode voltage so as to keep the voltage difference between the pixel electrode and the common electrode unchanged, thereby avoiding over high temperature of display panels, green tint of displayed images and crosstalk noise.

With reference to FIG. 2, the second compensation module 102 may comprise an operational amplifier that is provided with a non-inverting input terminal, an inverting input terminal and an output terminal. A first resistor R1 and a second resistor R2 are sequentially connected in series between the first input terminal (namely, the first input terminal of the second compensation module 102) and the output terminal of the operational amplifier. The inverting input terminal is connected between the first resistor R1 and the second resistor R2. Optionally, the first resistor R1 has a resistance equal to that of the second resistor R2. Optionally, a capacitor C may be connected in series between the second input terminal (namely, the second input terminal of the second compensation module 102) and the non-inverting input terminal. The second compensation module 102 superposes the compensation voltage inputted by the second input terminal on gamma voltage inputted by the first input terminal, and outputs the superposed gamma voltage, so as to effectively compensate for and inhibit the fluctuation of the common electrode voltage, thereby avoiding over high temperature of display panels, green tint of displayed images and crosstalk noise.

The drive circuit provided by the present embodiment comprises a compensation circuit, which comprises a first compensation module 101 and a second compensation module 102. The first compensation module 101 generates compensation voltage according to the variation of common electrode voltage; and the second compensation module 102 superposes the compensation voltage inputted by the second input terminal on gamma voltage inputted by the first input terminal, and outputs the superposed gamma voltage. The present embodiment transfers a compensation position from the common electrode voltage to the gamma voltage, and effectively compensates for and inhibits the fluctuation of the common electrode voltage by the compensation voltage superposed on the gamma voltage, thereby avoiding over high temperature of display panels, green tint of displayed images and crosstalk noise.

Figure 4:
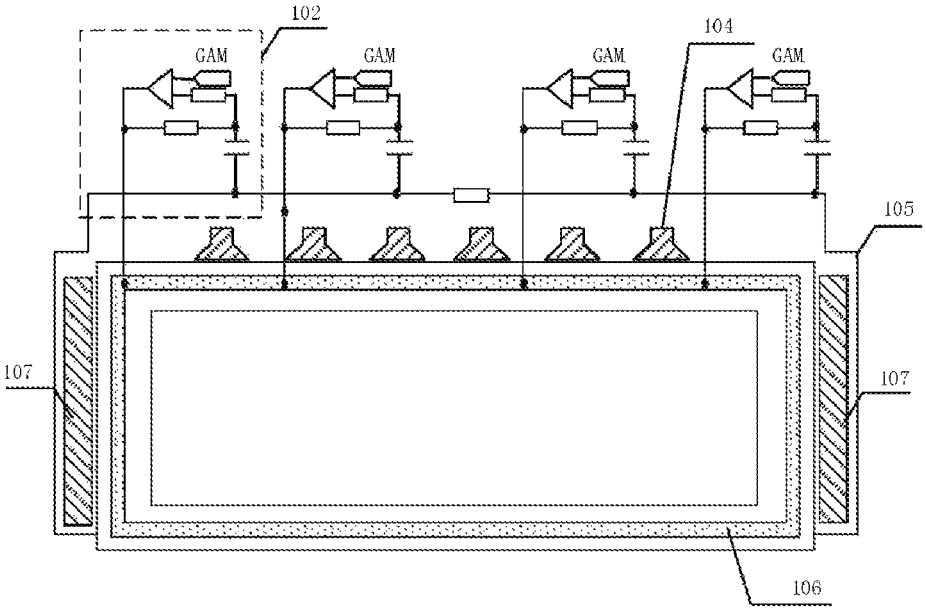
FIG. 4 is a structural schematic view of a display device according to an embodiment.

FIG. 4 is a structural schematic view of a display device according to an embodiment. As shown in FIG. 4, the display device comprises the drive circuit provided by the above embodiment. Specific structures and functions of the drive circuit can be understood with reference to the description of the above embodiments, which will not be reiterated herein.

With reference to FIG. 4, a GOA (Gate Driver on Array) 107 is arranged on both sides of the display area. The first compensation module 101 (not shown) generates compensation voltage according to the variation of the common electrode voltage and then transmits the compensation voltage to the second compensation module 102 through a compensation voltage line 105. The gamma voltage module 103 (not shown) generates gamma voltage and then transmits the gamma voltage to the second compensation module 102. The first input terminal of the second compensation module 102 receives the gamma voltage, the second input terminal of the second compensation module 102 receives the compensation voltage, and the second compensation module 102 superposes the compensation voltage on the gamma voltage and then transmits the superposed gamma voltage to the source drive module 104 through a data line 106. The source drive module 104 receives the superposed gamma voltage and then generates the drive voltage according to the superposed gamma voltage. The drive voltage is applied to a pixel electrode. The pixel electrode and a common electrode make up of a pixel capacitor, and the voltage difference between the pixel electrode and the common electrode decides a deflection angle of liquid crystal molecules within the pixel capacitor. That is to say, the voltage difference between the pixel electrode and the common electrode decides the gray scale of display panels. Under normal circumstances, the voltage of the common electrode is constant, and the deflection angle of liquid crystal molecules can be controlled by controlling the voltage of the pixel electrode, so as to achieve an expected display effect. However, when a capacitive coupling effect results in fluctuation of common electrode voltage, the voltage difference between the common electrode and the pixel electrode is no longer controllable. At that time, the second compensation module 102 can superpose a corresponding compensation voltage on the existing gamma voltage so as to maintain the voltage difference between the pixel electrode and the common electrode unchanged. That is to say, the compensation voltage can counteract the variation of the common electrode voltage so as to keep the voltage difference between the pixel electrode and the common electrode unchanged, thereby avoiding over high temperature of display panels, green tint of displayed images and crosstalk noise.

The display device provided by the present embodiment comprises a compensation circuit. The compensation circuit comprises a first compensation module 101 and a second compensation module 102. The first compensation module 101 generates compensation voltage according to the variation of common electrode voltage. The second compensation module 102 superposes the compensation voltage inputted by the second input terminal on gamma voltage inputted by the first input terminal, and outputs the superposed gamma voltage. The present embodiment transfers a compensation position from the common electrode voltage to the gamma voltage, and effectively compensates for and inhibits the fluctuation of the common electrode voltage by the compensation voltage superposed on the gamma voltage, thereby avoiding over high temperature of display panels, green tint of displayed images and crosstalk noise.

Figure 5:
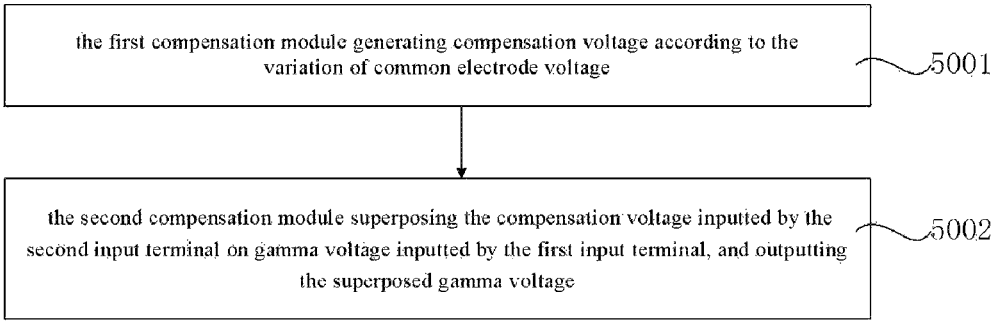
FIG. 5 is a flowchart illustrating an operating method of a compensation circuit according to an embodiment.

FIG. 5 is a flowchart illustrating an operating method of a compensation circuit according to an embodiment, wherein the compensation circuit comprises a first compensation module and a second compensation module that is provided with a first input terminal, a second input terminal and an output terminal.

As shown in FIG. 5, the operating method comprises:

At step 5001, the first compensation module generates compensation voltage according to the variation of common electrode voltage. The first compensation module is connected to the second input terminal of the second compensation module, and outputs the generated compensation voltage to the second input terminal of the second compensation module.

With reference to FIG. 1, the compensation circuit comprises a first compensation module 101 and a second compensation module 102. The second compensation module 102 is provided with a first input terminal, a second input terminal and an output terminal, and the second input terminal is connected with the first compensation module 101. The first compensation module 101 generates compensation voltage according to the variation of common electrode voltage, and then transmits the compensation voltage to the second compensation module 102.

At step 5002, the second compensation module superposes the compensation voltage inputted by the second input terminal on gamma voltage inputted by the first input terminal, and outputs the superposed gamma voltage.

In the present embodiment, the first input terminal of the second compensation module 102 receives the gamma voltage, the second input terminal of the second compensation module 102 receives the compensation voltage, and the second compensation module 102 superposes the compensation voltage on the gamma voltage and then outputs the superposed gamma voltage. The superposed gamma voltage is applied to a pixel electrode by a source driver. The pixel electrode and a common electrode make up of a pixel capacitor, and the voltage difference between the pixel electrode and the common electrode decides a deflection angle of liquid crystal molecules within the pixel capacitor. That is to say, the voltage difference between the pixel electrode and the common electrode decides the gray scale of display panels. Under normal circumstances, the voltage of the common electrode is constant, and the deflection angle of liquid crystal molecules can be controlled by controlling the voltage of the pixel electrode, so as to achieve an expected display effect. However, when a capacitive coupling effect results in fluctuation of common electrode voltage, the voltage difference between the common electrode and the pixel electrode is no longer controllable. At that time, the second compensation module 102 can superpose a corresponding compensation voltage on the existing gamma voltage so as to maintain the voltage difference between the pixel electrode and the common electrode unchanged. That is to say, the compensation voltage can counteract the variation of the common electrode voltage so as to keep the voltage difference between the pixel electrode and the common electrode unchanged, thereby avoiding over high temperature of display panels, green tint of displayed images and crosstalk noise.

With reference to FIG. 2, the second compensation module 102 may comprise an operational amplifier that is provided with a non-inverting input terminal, an inverting input terminal and an output terminal. A first resistor R1 and a second resistor R2 are sequentially connected in series between the first input terminal (namely, the first input terminal of the second compensation module 102) and the output terminal of the operational amplifier. The inverting input terminal is connected between the first resistor R1 and the second resistor R2. Optionally, the first resistor R1 has a resistance equal to that of the second resistor R2. Optionally, a capacitor C may be connected in series between the second input terminal (namely, the second input terminal of the second compensation module 102) and the non-inverting input terminal. The second compensation module 102 superposes the compensation voltage inputted by the second input terminal on gamma voltage inputted by the first input terminal, and outputs the superposed gamma voltage, so as to effectively compensate for and inhibit the fluctuation of the common electrode voltage, thereby avoiding over high temperature of display panels, green tint of displayed images and crosstalk noise.

In the operating method of the compensation circuit provided by the present embodiment, the compensation circuit comprises a first compensation module 101 and a second compensation module 102; the first compensation module 101 generates compensation voltage according to the variation of common electrode voltage; and the second compensation module 102 superposes the compensation voltage inputted by the second input terminal on gamma voltage inputted by the first input terminal, and outputs the superposed gamma voltage. The present embodiment transfers a compensation position from the common electrode voltage to the gamma voltage, and effectively compensates for and inhibits the fluctuation of the common electrode voltage by the compensation voltage superposed on the gamma voltage, thereby avoiding over high temperature of display panels, green tint of displayed images and crosstalk noise.

Figure 6:
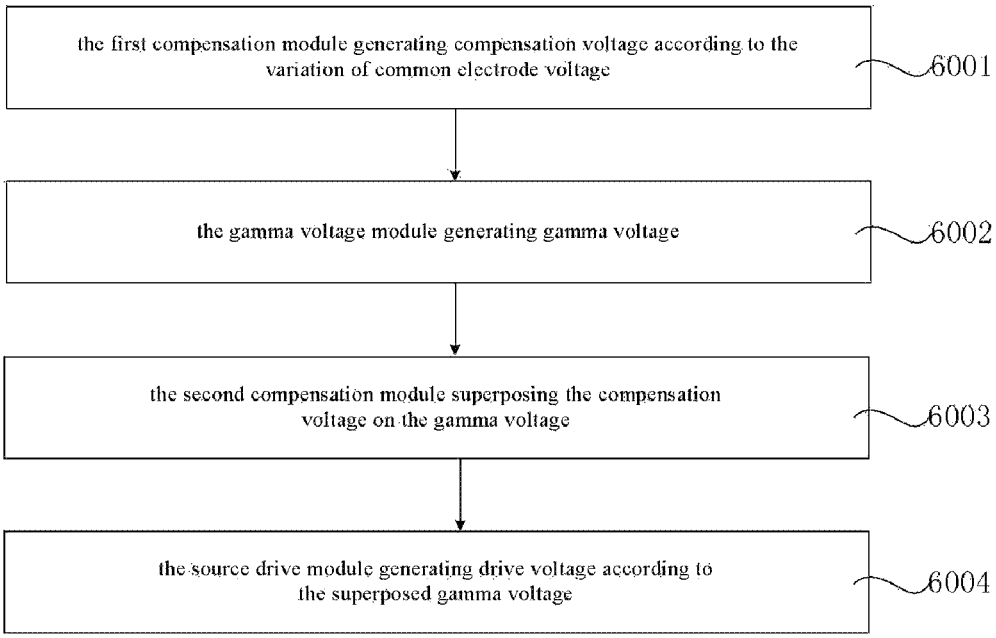
FIG. 6 is a flowchart illustrating an operating method of a drive circuit according to an embodiment.

FIG. 6 is a flowchart illustrating an operating method of a drive circuit according to an embodiment, wherein the drive circuit comprises a first compensation module, a second compensation module, a gamma voltage module and a source drive module. The second compensation module is provided with a first input terminal, a second input terminal and an output terminal.

As shown in FIG. 6, the operating method comprises:

At step 6001, the first compensation module generates compensation voltage according to the variation of common electrode voltage. The first compensation module is connected to the second input terminal of the second compensation module, and outputs the generated compensation voltage to the second input terminal of the second compensation module.

At step 6002, the gamma voltage module generates gamma voltage. The gamma voltage module is connected to the first input terminal of the second compensation module, and outputs the generated gamma voltage to the first input terminal of the second compensation module.

With reference to FIG. 3, the drive circuit comprises a first compensation module 101, a second compensation module 102, a gamma voltage module 103 and a source drive module 104. The second compensation module 102 is provided with a first input terminal, a second input terminal and an output terminal. The first input terminal is connected with the gamma voltage module 103, the second input terminal is connected with the first compensation module 101, and the output terminal of the second compensation module 102 is connected with the source drive module 104. The first compensation module 101 generates compensation voltage according to the variation of common electrode voltage, and transmits the compensation voltage to the second compensation module 102. The gamma voltage module 103 generates gamma voltage and transmits the gamma voltage to the second compensation module 102.

At step 6003, the second compensation module superposes the compensation voltage on the gamma voltage. The output terminal of the second compensation module is connected with the source drive module, and outputs the superposed gamma voltage to the source drive module.

At step 6004, the source drive module receives the superposed gamma voltage from the output terminal of the second compensation module, and generates drive voltage according to the superposed gamma voltage.

In the present embodiment, the first input terminal of the second compensation module 102 receives the gamma voltage, the second input terminal of the second compensation module 102 receives the compensation voltage, and the second compensation module 102 superposes the compensation voltage on the gamma voltage and then transmits the superposed gamma voltage to the source drive module 104. The source drive module 104 receives the superposed gamma voltage, and generates drive voltage according to the superposed gamma voltage. The drive voltage is applied to a pixel electrode. The pixel electrode and a common electrode make up of a pixel capacitor, and the voltage difference between the pixel electrode and the common electrode decides a deflection angle of liquid crystal molecules within the pixel capacitor. That is to say, the voltage difference between the pixel electrode and the common electrode decides the gray scale of display panels. Under normal circumstances, the voltage of the common electrode is constant, and the deflection angle of liquid crystal molecules can be controlled by controlling the voltage of the pixel electrode, so as to achieve an expected display effect. However, when a capacitive coupling effect results in fluctuation of common electrode voltage, the voltage difference between the common electrode and the pixel electrode is no longer controllable. At that time, the second compensation module 102 can superpose a corresponding compensation voltage on the existing gamma voltage so as to maintain the voltage difference between the pixel electrode and the common electrode unchanged. That is to say, the compensation voltage can counteract the variation of the common electrode voltage so as to keep the voltage difference between the pixel electrode and the common electrode unchanged, thereby avoiding over high temperature of display panels, green tint of displayed images and crosstalk noise.

With reference to FIG. 2, the second compensation module 102 may comprise an operational amplifier that is provided with a non-inverting input terminal, an inverting input terminal and an output terminal. A first resistor R1 and a second resistor R2 are sequentially connected in series between the first input terminal (namely, the first input terminal of the second compensation module 102) and the output terminal of the operational amplifier. The inverting input terminal is connected between the first resistor R1 and the second resistor R2. Optionally, the first resistor R1 has a resistance equal to that of the second resistor R2. Optionally, a capacitor C may be connected in series between the second input terminal (namely, the second input terminal of the second compensation module 102) and the non-inverting input terminal. The second compensation module 102 superposes the compensation voltage inputted by the second input terminal on gamma voltage inputted by the first input terminal, and outputs the superposed gamma voltage, so as to effectively compensate for and inhibit the fluctuation of the common electrode voltage, thereby avoiding over high temperature of display panels, green tint of displayed images and crosstalk noise.

In the operating method of the drive circuit provided by the present embodiment, the drive circuit comprises a compensation circuit. The compensation circuit comprises a first compensation module 101 and a second compensation module 102. The first compensation module 101 generates compensation voltage according to the variation of common electrode voltage. The second compensation module 102 superposes the compensation voltage inputted by the second input terminal on gamma voltage inputted by the first input terminal, and outputs the superposed gamma voltage. The present embodiment transfers a compensation position from the common electrode voltage to the gamma voltage, and effectively compensates for and inhibits the fluctuation of the common electrode voltage by the compensation voltage superposed on the gamma voltage, thereby avoiding over high temperature of display panels, green tint of displayed images and crosstalk noise.

What needs to be explained is that the above embodiments are only explained by way of example according to the division of different function modules. In actual application, the above functions can be allocated to different functional modules as desired. The internal structure of the device can be divided into different functional modules so as to accomplish all or part of the functions as stated above. In addition, the function of one module can be achieved by a plurality of modules, and the functions of the plurality of modules can be integrated into one module.

It is to be understood that the above embodiments are only exemplary for the sake of explaining the principle of the present invention, and the present invention should not be limited thereto. As far as those skilled in the art are concerned, various variations and modifications can be made without departing from the spirit and nature of the present invention and shall be deemed as falling within the protection scope of the present invention. The protection scope of the present invention should depend on the protection scope of the appended claims.

The term "and/or" used herein is only used to describe the connecting relations between objects connected thereby, which may be of three types. For instance, "A and/or B" can represent the following three conditions: either A, or B, or both A and B. In addition, the character "/" used herein generally indicates that the former and the latter objects connected thereby is in a "or" relationship.

The words, such as "first", "second" and "third", are used in the present application. Such a word is not intended to imply a sequence but for the sake of identification, unless in a certain context. For instance, the expressions "the first edition" and "the second edition" do not necessarily mean that the first edition is just the No. 1 edition or created prior to the second edition, or the first edition is required or operated before the second edition. In fact, these expressions are used to identify different versions.

In the claims, any reference numeral in parentheses should not be interpreted as a limitation to the claims. The term "comprise" does not exclude the presence of other elements or steps in addition to those listed in the claims. The words "a" or "an" preceding elements do not exclude the possibility of a plurality of such elements. The present invention can be carried out by means of hardware including a plurality of separate elements, or by appropriately programmed software or firmware, or by any combination thereof.

In the product or system claims that enumerate several devices, one or more of the devices can be embodied in the same item of hardware. The mere fact that some measure is recited in dependent claims that are different from each other does not indicate that the combination of the measures cannot be used to advantage.

The invention claimed is:

1. A compensation circuit comprising a first compensator and a second compensator that is provided with a first input terminal, a second input terminal and an output terminal;

the first compensator is configured for generating compensation voltage according to the variation of common electrode voltage, and outputting the generated compensation voltage to the second input terminal of the second compensator; and the second compensator is configured for superposing the compensation voltage inputted by the second input terminal on gamma voltage inputted by the first input terminal, and outputting the superposed gamma voltage, wherein the second compensator comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, and the non-inverting input terminal is connected with the second input terminal.

2. The compensation circuit according to claim 1, wherein the first resistor has a resistance equal to that of the second resistor.

3. The compensation circuit according to claim 1, wherein a capacitor is connected in series between the second input terminal and the non-inverting input terminal.

4. A drive circuit, comprising a first compensator, a second compensator, a gamma voltage generator and a source driver, wherein the second-compensator is provided with a first input terminal, a second input terminal and an output terminal;

the first compensator is configured for generating compensation voltage according to the variation of common electrode voltage, and outputting the generated compensation voltage to the second input terminal of the second compensator;

the gamma voltage generator is configured for generating gamma voltage and outputting the generated gamma voltage to the first input terminal of the second compensator;

the second compensator is configured for superposing the compensation voltage on the gamma voltage; and the source driver is configured for receiving the superposed gamma voltage from the output terminal of the second compensator, and generating drive voltage according to the superposed gamma voltage, wherein the second compensator comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, the non-inverting input terminal is connected with the second input terminal, and the output terminal of the operational amplifier is connected with the source driver.

5. The drive circuit according to claim 4, wherein the first resistor has a resistance equal to that of the second resistor.

6. The drive circuit according to claim 4, wherein a capacitor is connected in series between the second input terminal and the non-inverting input terminal.

7. A display device comprising the drive circuit according to claim 4.

8. An operating method of a compensation circuit, wherein the compensation circuit comprises a first compensator and a second-compensator that is provided with a first input terminal, a second input terminal and an output terminal;

wherein the second compensator comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, and the non-inverting input terminal is connected with the second input terminal, the operating method comprises the steps of:

the first compensator generating compensation voltage according to the variation of common electrode voltage, and outputting the generated compensation voltage to the second input terminal of the second compensator; and the second compensator superposing the compensation voltage inputted by the second input terminal on gamma voltage inputted by the first input terminal, and outputting the superposed gamma voltage.

9. An operating method of a drive circuit, wherein the drive circuit comprises a first compensator, a second compensator, a gamma voltage generator and a source driver, and the second compensator is provided with a first input terminal, a second input terminal and an output terminal;

wherein the second compensator comprises an operational amplifier that is provided with a non-inverting input terminal, an inverting input terminal and an output terminal, a first resistor and a second resistor are sequentially connected in series between the first input terminal and the output terminal of the operational amplifier, the inverting input terminal is connected between the first resistor and the second resistor, the non-inverting input terminal is connected with the second input terminal, and the output terminal of the operational amplifier is connected with the source driver, the operating method comprises the steps of:

the first compensator generating compensation voltage according to the variation of common electrode voltage, and outputting the generated compensation voltage to the second input terminal of the second compensator;

the gamma voltage generator generating gamma voltage and outputting the generated gamma voltage to the first input terminal of the second compensator;

the second compensator superposing the compensation voltage on the gamma voltage; and the source driver receiving the superposed gamma voltage from the output terminal of the second compensator, and generating drive voltage according to the superposed gamma voltage.

* * * * *